US008973188B1

(12) United States Patent
Amini

(10) Patent No.: US 8,973,188 B1
(45) Date of Patent: Mar. 10, 2015

(54) PELVIC POSITIONING SYSTEM

(71) Applicant: Richard Amini, Tucson, AZ (US)

(72) Inventor: Richard Amini, Tucson, AZ (US)

( * ) Notice: Subject to any disclaimer, the term of this patent is extended or adjusted under 35 U.S.C. 154(b) by 0 days.

(21) Appl. No.: 14/055,208

(22) Filed: Oct. 16, 2013

Related U.S. Application Data

(60) Provisional application No. 61/715,608, filed on Oct. 18, 2012.

(51) Int. Cl.
*A47B 7/00* (2006.01)
*A61G 13/12* (2006.01)
*A61G 9/00* (2006.01)

(52) U.S. Cl.
CPC ..... *A61G 13/123* (2013.01); *A61G 13/1225* (2013.01); *A61G 9/003* (2013.01)
USPC ..... 5/621; 5/604; 5/618; 5/632; 5/648; 5/649

(58) Field of Classification Search
USPC ..... 5/604, 619, 652, 636, 624, 602, 620, 5/621, 622, 632, 722, 648, 649; 600/587; 128/845
See application file for complete search history.

(56) References Cited

U.S. PATENT DOCUMENTS

| | | | | |
|---|---|---|---|---|
| 6,256,817 | B1 | 7/2001 | McGuire et al. | |
| 8,607,385 | B2 * | 12/2013 | Isham | 5/621 |
| 2011/0306901 | A1 * | 12/2011 | Gilley et al. | 600/587 |
| 2012/0304387 | A1 * | 12/2012 | Crompton et al. | 5/632 |

OTHER PUBLICATIONS www.universalbedpan.com, Wedgie: Pelvic Exam Wedge, Website, accessed Oct. 16, 2013.

* cited by examiner

*Primary Examiner* — Peter M Cuomo
*Assistant Examiner* — Brittany Wilson

(57) ABSTRACT

A pelvic positioning system for positioning a patient's pelvic area for a pelvic or rectal exam featuring a base with an indentation disposed in the front end for providing the physician access to the patient's pelvic region. Two peaks for the patient's thighs are disposed at the front end of the base and are separated by the indentation. An inward curvature is disposed in the top surface of the base between the indentation and the back end of the base. The system functions to position a patient's pelvic region comfortably and effectively.

18 Claims, 21 Drawing Sheets

PELVIC POSITIONING SYSTEM

CROSS REFERENCE

This application claims priority to Provisional U.S. Patent Application No. 61/715,608 filed Oct. 18, 2012, the specification(s) of which is/are incorporated herein in their entirety by reference.

FIELD OF THE INVENTION

The present invention relates to seats, cushions, or bedpans for patients, more particularly to a system for positioning a patient's pelvic region for a pelvic exam or rectal exam.

BACKGROUND OF THE INVENTION

Emergency departments, urgent cares, and general practitioners perform millions of pelvic exams (and rectal exams) per year. The present invention features a pelvic positioning system for positioning a patient's pelvic area in an appropriate position (e.g., an appropriate angle, elevation, etc.) for a pelvic exam or rectal exam (or any other exam wherein pelvic positioning is desired). The system of the present invention may be used on an existing surface, such as an existing exam table, a gurney, etc. The system of the present invention is portable, lightweight, and may be stored easily. The system may provide comfort to a patient.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a pelvic positioning system (100) for positioning a patient's pelvic area for a pelvic or rectal exam. In some embodiments, the system (100) comprises a base (110) having a top surface (115), a bottom surface (116), a first side end (111) and a second side end (112) opposite the first side end (111), a front end (113), and a back end (114) opposite the front end (113); an indentation (120) disposed in the front end (113) of the base (110), the indentation (120) extends inwardly in the direction of the back end (114) of the base (110), the indentation (120) extends from the top surface (115) of the base (110) to the bottom surface (116) of the base (110) to create a space for a physician to perform a pelvic exam; a first peak (150*a*) extending upwardly from the top surface (115) of the base (110) at an intersection of the first side (111) of the base (110) and the front end (113) of the base (110), and a second peak (150*b*) extending upwardly from the top surface (115) of the base (110) at an intersection of the second side (112) of the base (110) and the front end (113) of the base (110), the peaks (150) are separated by the indentation (120); and an inward curvature (210) disposed in the top surface (115) of the base (110) between a midsection (119) of the base (110) and the front end (113) of the base (110) extending from at of near the first side end (111) to at or near the second side end (112), the inward curvature 210 curves inwardly toward the bottom surface (116) of the base (110), the inward curvature (210) creates a midsection peak (220) in the top surface (115) of the base (110) behind the inward curvature (210), wherein a height of the top surface (115) of the base (110) at the midsection peak (220) is higher than a height of the top surface (115) of the base (110) at the inward curvature (210).

In some embodiments, the indentation (120) is U-shaped as viewed from the top surface (115). In some embodiments, the indentation (120) is rectangular as viewed from the top surface (115). In some embodiments, a peak indentation (158) is disposed in atop surface (155) of each peak (150). In some embodiments, inner side surfaces (152) of the peaks (150) slope downwardly toward the indentation (120). In some embodiments, inner side surfaces (152) of the peaks (150) form a concave peak curve (153) in combination with a top inner edge (126) of the indentation (120). In some embodiments, the top surface (115) of the base (110) slopes downwardly from the midsection peak (220) to the back end (114) of the base (110).

In some embodiments, the system (100) further comprises a pair of stirrups (310). In some embodiments, the stirrups (310) are retractable and are housed in stirrup cavities (320) disposed inside the base (110) and accessible via openings (318) in the front end (113) of the base (110). In some embodiments, the stirrups (310) are removably attachable to the base (110) via an attachment means. In some embodiments, a clip (334) is disposed on an inside surface of the stirrup (310), the clip (334) engages a clip connection (335) disposed on the front surface (113) of the base (110). In some embodiments, the stirrups (310) are pivotally attached to the front end (113) of the base (110) at a top edge of the front end (113) of the base (110), the stirrups (310) are attached via hinges (330), wherein the stirrups (310) can pivot between a storage position wherein the stirrup (310) rests atop the base (110) and an extended position wherein the stirrup (310) pivots away from the base (110) and extends a distance from the base (110).

In some embodiments, the system (100) further comprises a bedpan (420) disposed in the bottom surface (116) of the base (110). In some embodiments, the system (100) further comprises a storage cavity (410) disposed in the bottom surface (116) of the base (110). In some embodiments, the system (100) further comprises a backrest (350). In some embodiments, the backrest (350) is attachable to the back end (114) of the base (110). In some embodiments, the backrest (350) is extendable outwardly from the back end (114) of the base (110). In some embodiments, the backrest (350) is housed in a backrest cavity (360) disposed inside the base (110) and accessible via an opening (362) disposed in the back end (114) of the base (110).

DESCRIPTION OF PREFERRED EMBODIMENTS

Figure 1:
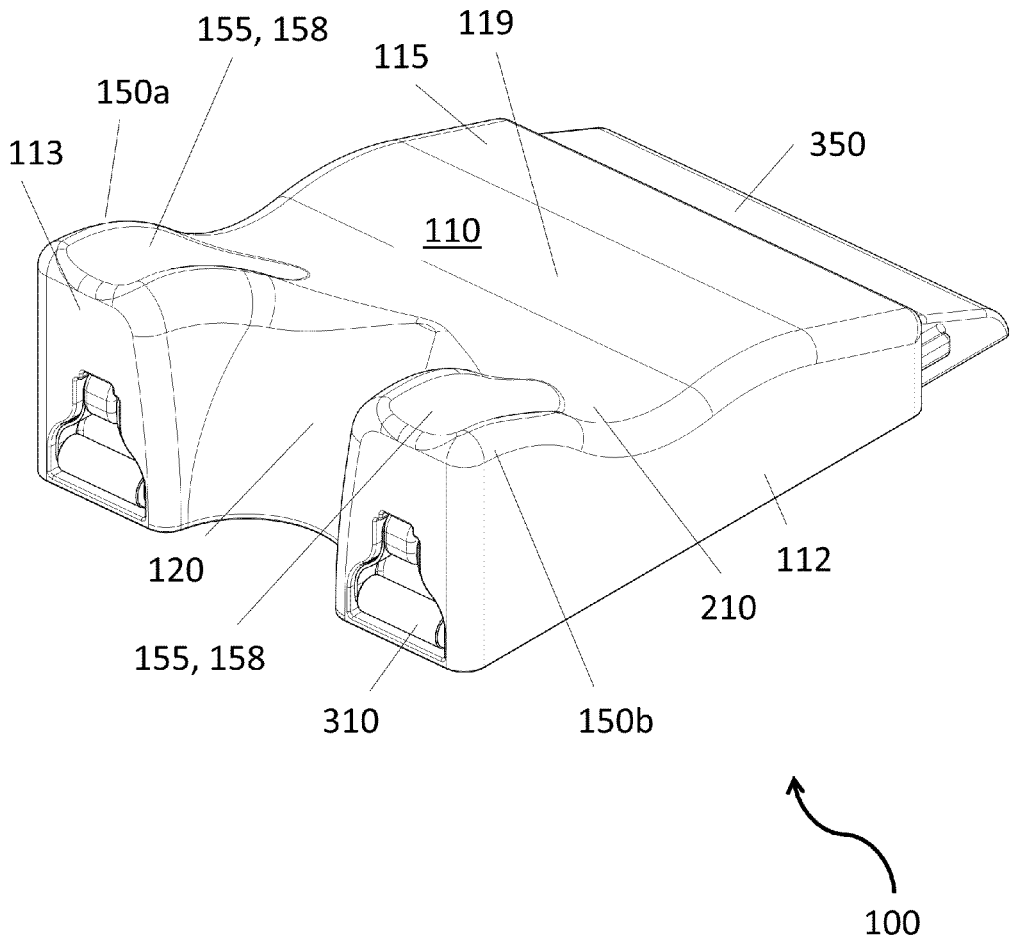
FIG. 1 is a perspective view of an embodiment of the system of the present invention.

Following is a list of elements corresponding to a particular element referred to herein:

100 pelvic positioning system
103*a* distance/height of peak
103*b* distance/height of indentation
103*c* depth of indentation
103*d* width of indentation
103*e* width of base
103*f* length of base
110 base
111 first side end of base
112 second side end of base
113 front end of base
114 back end of base
115 top surface of base
116 bottom surface of base
119 midsection of base
120 indentation
126 inner end of indentation (top inner edge)
126*b* bottom edge of indentation (bottom inner edge)
150*a* first peak
150*b* second peak
152*a* inner side surface of peak
152*b* inner side surface of peak
153*a* peak curve
153*b* peak curve
155 top surface of peak
158 peak indentation
210 inner curvature
220 midsection peak
310 stirrups (e.g., leg hold er
313 top surface of stirrup
318 stirrup opening
320 stirrup cavity
330 hinge
332 stirrup indentation
334 clip
336 stopper (e.g., stopper flange)
350 backrest
360 backrest cavity
362 opening
410 storage compartment
420 bedpan Referring now to FIG. 1-15, the present invention features a pelvic positioning system (100) for positioning a patient's pelvic area in an appropriate position (e.g., an appropriate position, angle, elevation, etc.) for a pelvic exam (or rectal exam or any other necessary procedure). The system (100) of the present invention may help provide physical comfort to the patient. The system (100) of the present invention may also help provide psychological comfort to the patient. For example, some patients may experience stress and feel uncomfortable because they do not know how to position themselves for pelvic exams. For example, some patients are positioned on bedpans, which can be uncomfortable (and archaic). The system (100) of the present invention may provide patients with physical cues so that they can intuitively understand how to position themselves.

The system (100) comprises a base (110) having a top surface (115), e.g., a "patient surface" that accommodates the patient's gluteal area (and optionally back area), a bottom surface (116), e.g., a surface that is placed atop an existing surface (e.g., an exam table), side ends (e.g., a first side end (111) and a second side end (112) opposite the first side end (111)), a front end (113), e.g., a surface that faces the physician performing the pelvic exam, and a back end (114) opposite the front end (113). The bottom surface (116) of the base may be generally flat so as to lie appropriately on an existing surface (e.g., an exam table). However, the bottom surface (116) is not limited to a flat configuration. For example, in some embodiments, a portion of the bottom surface (116) is flat and a storage compartment or a bedpan is disposed in the bottom surface (116) (as described below). As described below, the top surface (115) of the base (110) comprises curvatures that help appropriately position the patient's body for a pelvic exam and provide comfort to the patient.

Figure 11:
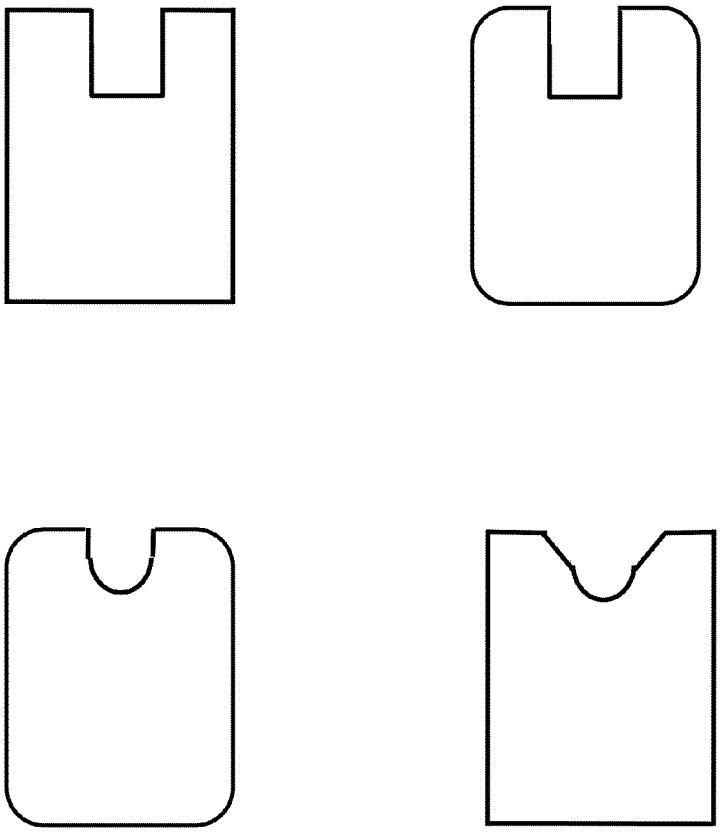
FIG. 11 shows top cross sectional views of various embodiments of the system of the present invention. The indentations in the examples shown in FIG. 11 are of different shapes (e.g., U-shaped, rectangular-shaped, rounded/slanted).

An indentation (120) is disposed in the front end (113) of the base (110). The indentation (120) functions to provide space for a physician to access the patient's pelvic area for a pelvic exam. The indentation (120) extends inwardly in the base (110) in the direction of the back end (114) of the base (110). Generally, the indentation (120) extends all the way from the top surface (115) to the bottom surface (116) of the base (110). In some embodiments, the indentation (120) is generally U-shaped as viewed from the top surface (115). The indentation (120) is not limited to a U-shape. For example, in some embodiments, the indentation (120) may have a square shape, oblong shape, triangular shape, pentagonal shape, irregular shape, rounded shape, or any other appropriate shape. Non-limiting examples of various indentation shapes are shown in FIG. 11. In some embodiments, the front end (113) of the base (110) is flat. In some embodiments, the edge between the front end (113) and the indentation (120) may be sharp, blunted, rounded, etc. The system (100) of the present invention is not limited to the aforementioned curvatures, configurations, and shapes. In some embodiments, the top inner edge (e.g., inner end (126)) of the indentation (120) is positioned farther back (e.g., closer to the back end (114) of the base (110)) than the bottom inner edge (126*b*) of the indentation (120) (see FIG. 2).

A first peak (150*a*) is disposed on the top surface (115) of the base (110) and extends upwardly from the top surface (115) of the base (110) at the intersection of the first side (111) of the base (110) and the front end (113) of the base (110). A second peak (150*b*) is disposed on the top surface (115) of the base (110) and extends upwardly from the top surface (115) of the base (110) at the intersection of the second side (112) of the base (110) and the front end (113) of the base (110). The peaks (150) function to help position a patient's legs (e.g., thighs) and gluteal area. For example, the peaks (150) help to position the patient's legs a distance apart so that a physician can access the pelvic area via the indentation (120).

Figure 8:
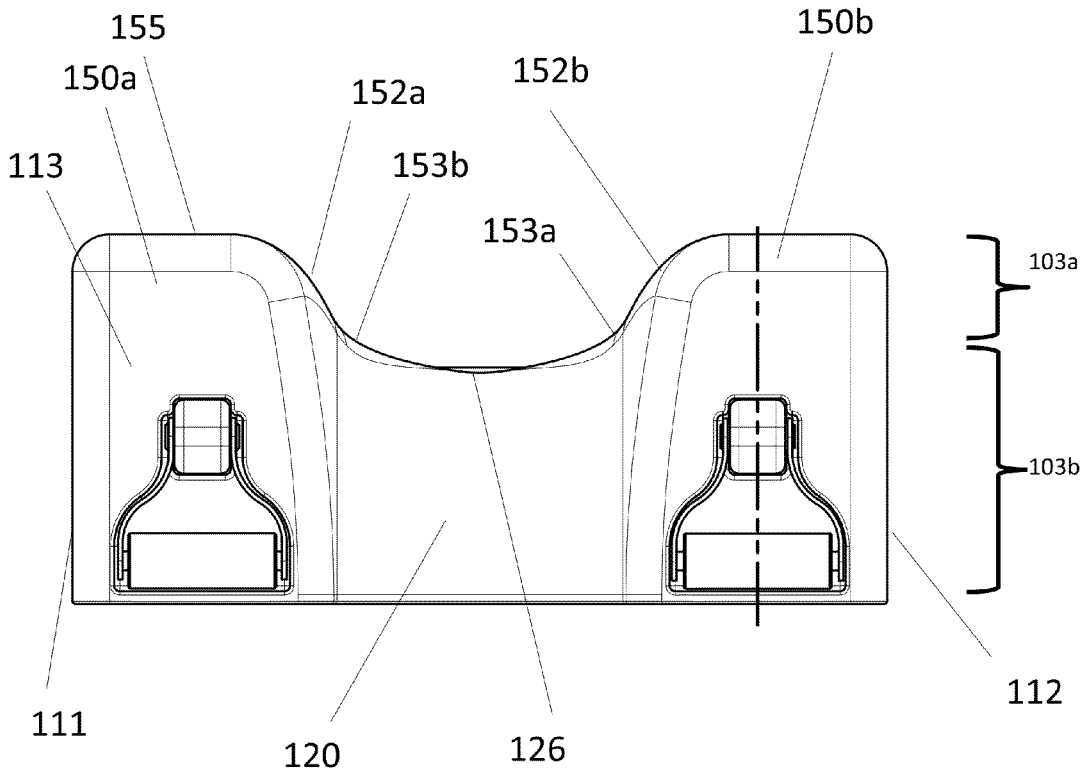
FIG. 8 is a front view of an embodiment of the system of the present invention.

In some embodiments, the peaks (150) have curved, rounded surfaces (e.g., as viewed from the front end (113) of the base (110)). The peaks (150) are not limited to a curved or rounded shape. For example, in some embodiments, the peaks (150) may have square or flat surfaces (e.g., as viewed from the front end (113) of the base (110)). As shown in FIG. 8, in some embodiments, the inner side surfaces (152) of the peaks (150) slope downwardly toward the indentation (120). In some embodiments, the inner side surfaces (152) form a concave peak curve (153) with the portion of the top surface (115) of the base (110) adjacent to the indentation (120). The inner side surfaces (152) and peak curves (153) can help properly position a patient and/or provide comfort to the patient.

Figure 5:
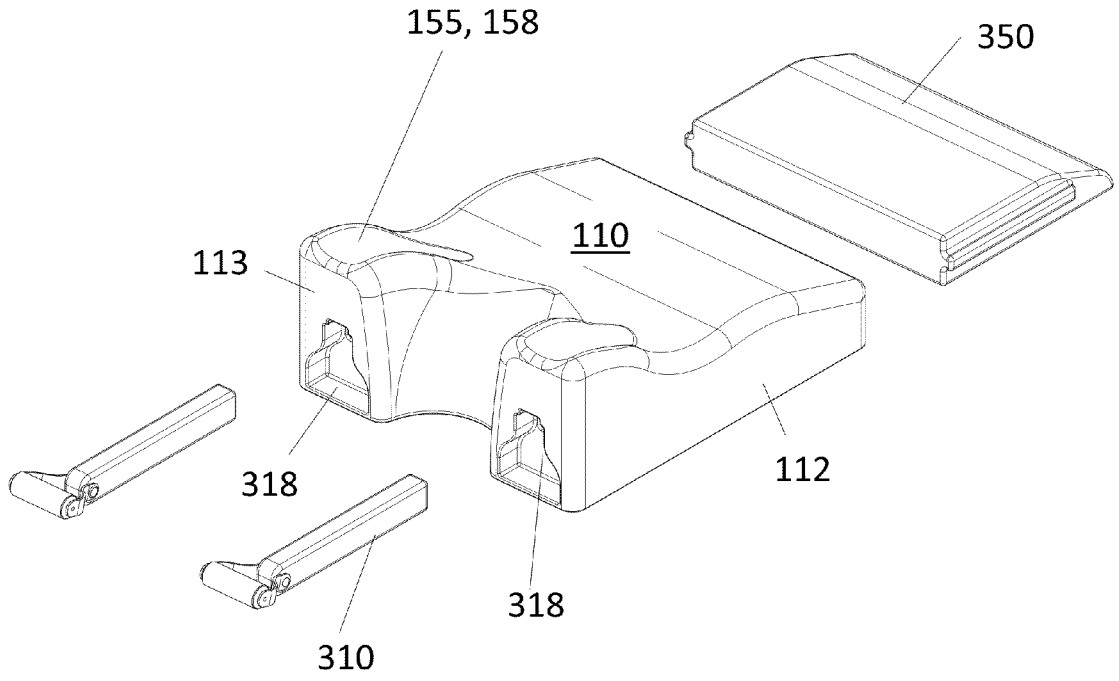
FIG. 5 is an exploded view of an embodiment of the system of the present invention.
Figure 6:
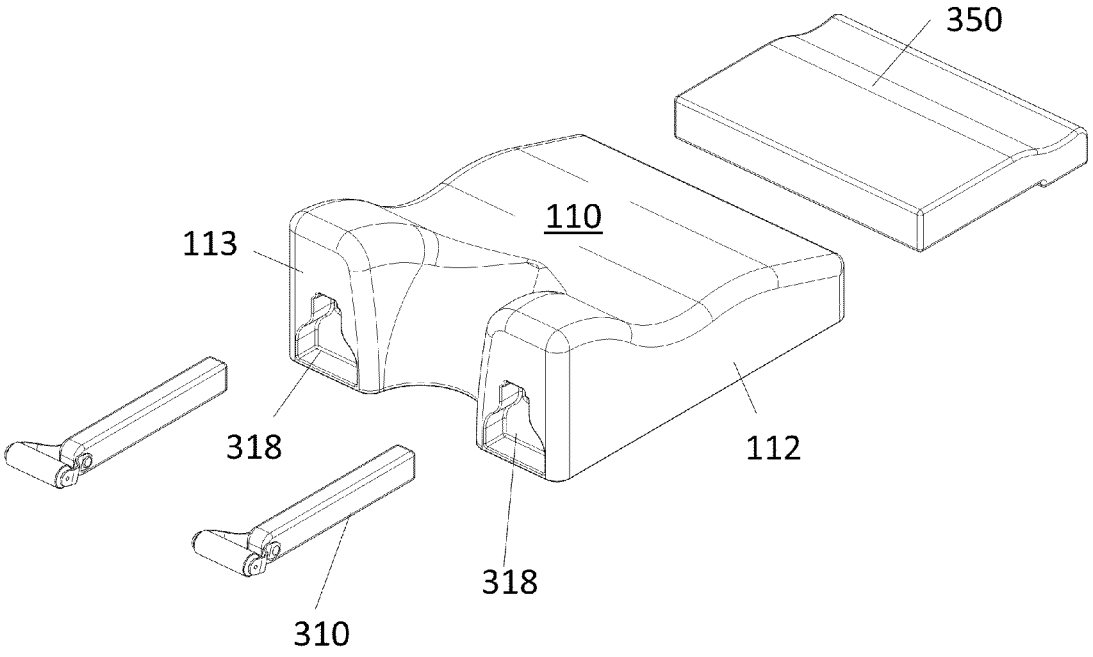
FIG. 6 is an exploded view of an embodiment of the system of the present invention.
Figure 7:
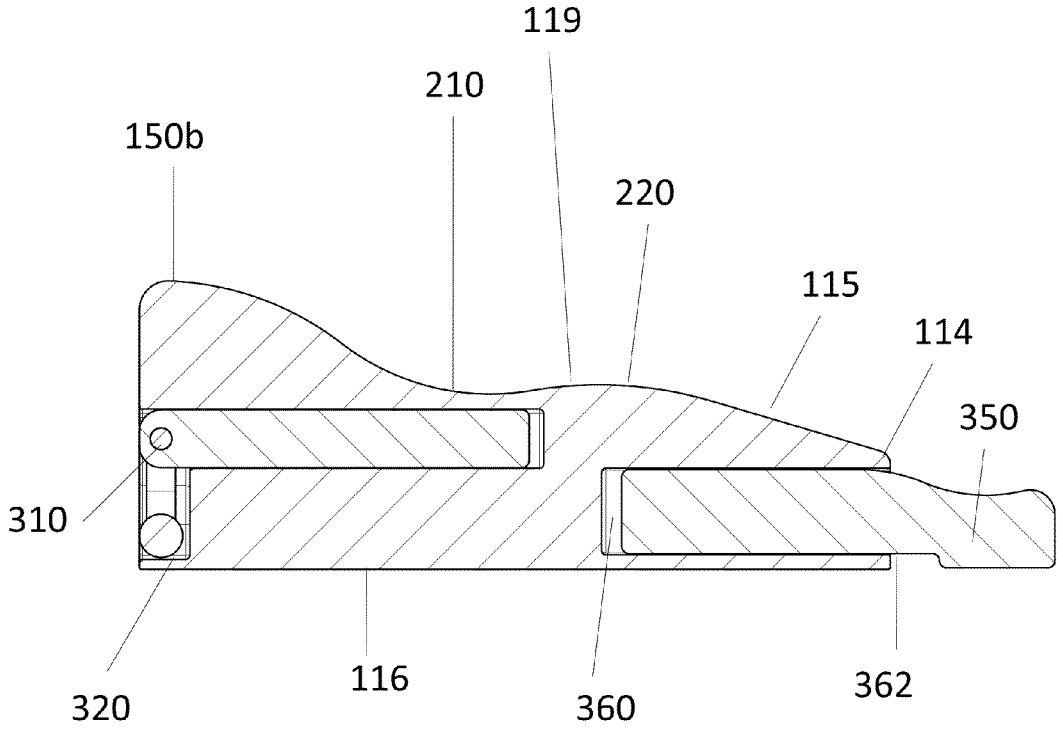
FIG. 7 is a side cross sectional view of an embodiment of the system of the present invention.
Figure 9:
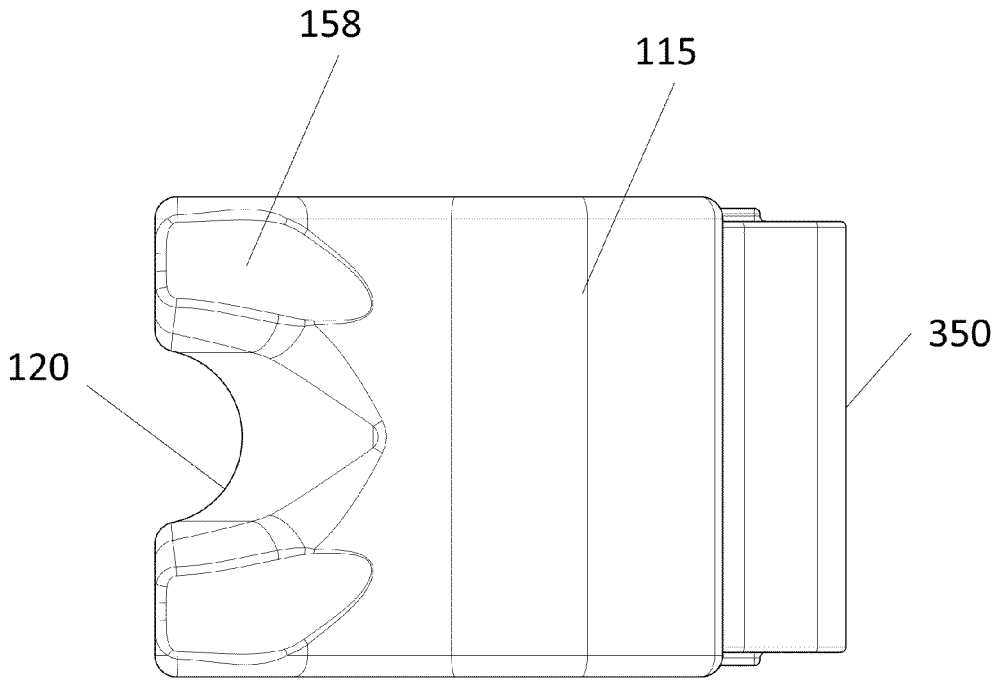
FIG. 9 is a top view of an embodiment of the system of the present invention.
Figure 10:
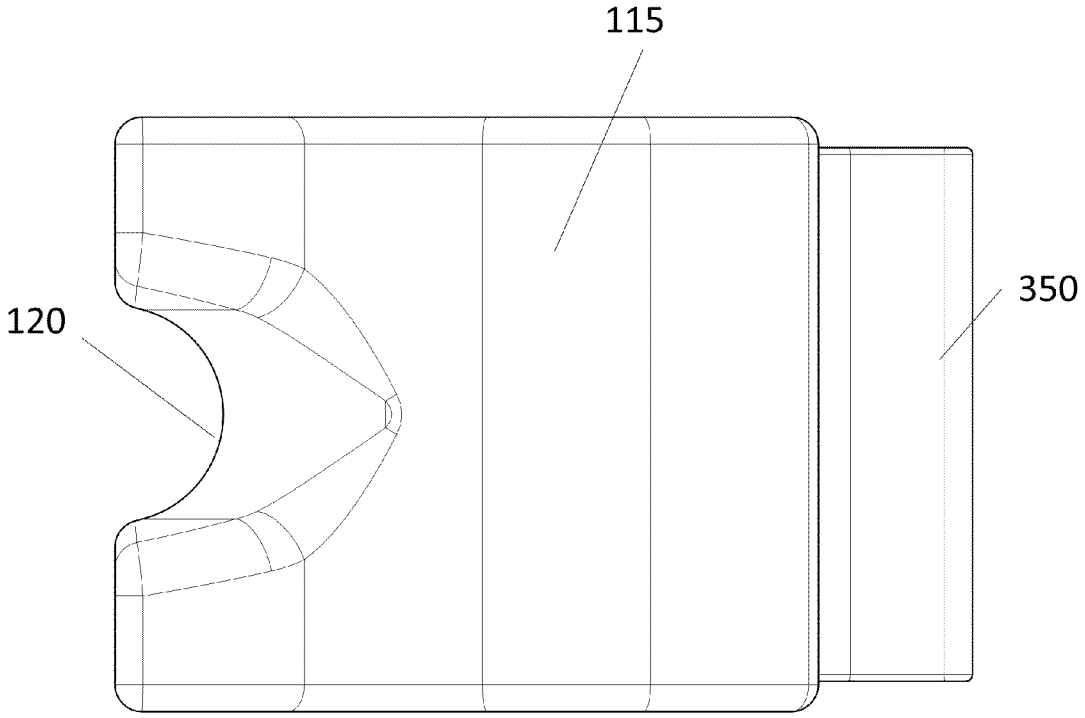
FIG. 10 is a top view of an embodiment of the system of the present invention.

In some embodiments, the top surfaces (155) of the peaks (150) comprise concave peak indentations (158) (see FIG. 5, FIG. 9). The concave peak indentations (158) may accommodate a patient's legs (e.g., thighs).

The peaks (150) are raised a distance (distance/height 103*a* shown in FIG. 8) above the height (103*b*) of the indentation (120) (height 103*b* shown in FIG. 8, e.g., the height of the portion of the top surface (115) of the base (110) at the indentation (120), e.g., the height of the top edge (126) of the indentation (120). In some embodiments, the height of the sides (111, 112) including the peaks (150) (e.g., the combination of distance 103*a* and distance 103*b* in FIG. 8) may be about 10-15 inches. In some embodiments, the height of the sides (111, 112) including the peaks (150) (e.g., the combination of distance 103*a* and distance 103*b* in FIG. 8) may be between about 8 to 16 inches. In some embodiments, the distance (103*a*) the peaks (150) extend above the height (103*b*) of the indentation (120) may be between about 2 to 6 inches (e.g., 2-3 inches, 2-4 inches, 2-5 inches, 3-4 inches, 4-5 inches, 3-6 inches, etc.). In some embodiments, the height (103*b*) of the indentation (120) (e.g., distance from the top inner edge (126) of indentation (120) to the bottom surface (116) of the base (110)) may be between about 4 to 12 inches, for example 4 to 7 inches, 4 to 8 inches, 5 to 10 inches, 7 to 10 inches, etc. The heights of the sides (111, 112), the height (103*b*) of the indentation (120), and the height (103*a*) of the peaks (150) are not limited to the aforementioned dimensions.

An inward curvature (210) is disposed in the top surface (115) of the base (110) between the midsection (119) of the base (110) and the innermost point (inner end/top inner edge (126)) of the indentation (120) extending from at or near the first side end (111) to at or near the second side end (112). The inward curvature 210 curves inwardly toward the direction of the bottom surface (116) of the base (110). The inward curvature (210) creates a midsection peak (220) extending from at or near the first side end (111) to at or near the second side end (112). The height of the top surface (115) of the base (110) at the midsection (119) is higher than the height of the top surface (115) of the base (110) in the inward curvature (210) and the height of the top surface (115) of the base (110) at the back end (114) of the base (110). The top surface (115) of the base (110) slopes downwardly from the midsection peak (220) to the back end (114) of the base (110).

In some embodiments, the system (100) further comprises stirrups (310), e.g., a pair of stirrups (310). The stirrups (310) may be attachable to, pivot from, or be extendable outwardly from the base (110), e.g., the front end (113) of the base (110). For example, in some embodiments, the base (110) houses retractable stirrups that can be accessed via the front end (113) of the base (110). In some embodiments, a first stirrup is attachable to or extends outwardly from or pivots about the front end (113) of the base near the first side (111) and first peak (150*a*), and a second stirrup is attachable to or extends outwardly from or pivots about the front end (113) of the base near the second side (112) and first peak (150*b*). The stirrups (310) may be used to aid in patient comfort and/or to help orient the patient. Stirrups for obstetrics are well known to one of ordinary skill in the art.

Figure 15A:
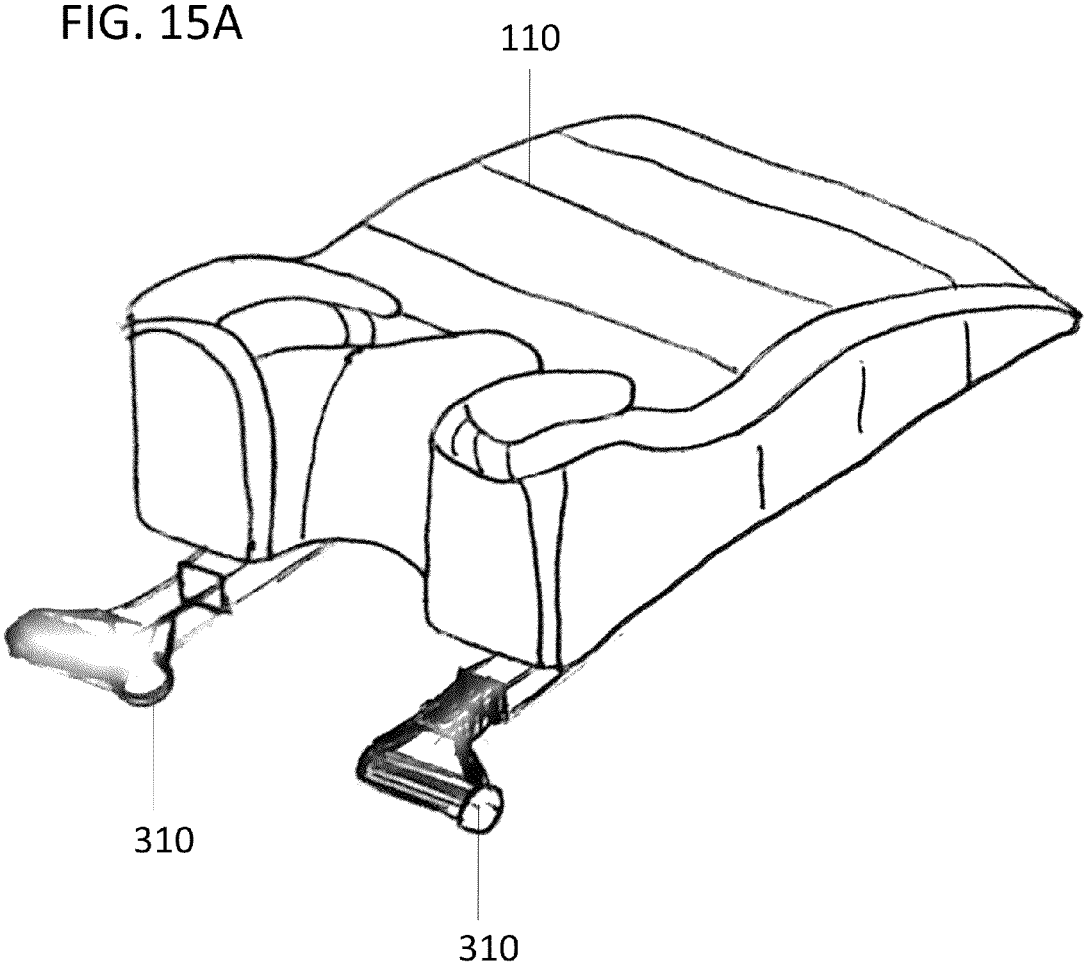
FIG. 15A shows an embodiment of the system of the present invention comprising telescopic stirrups.
Figure 15B:
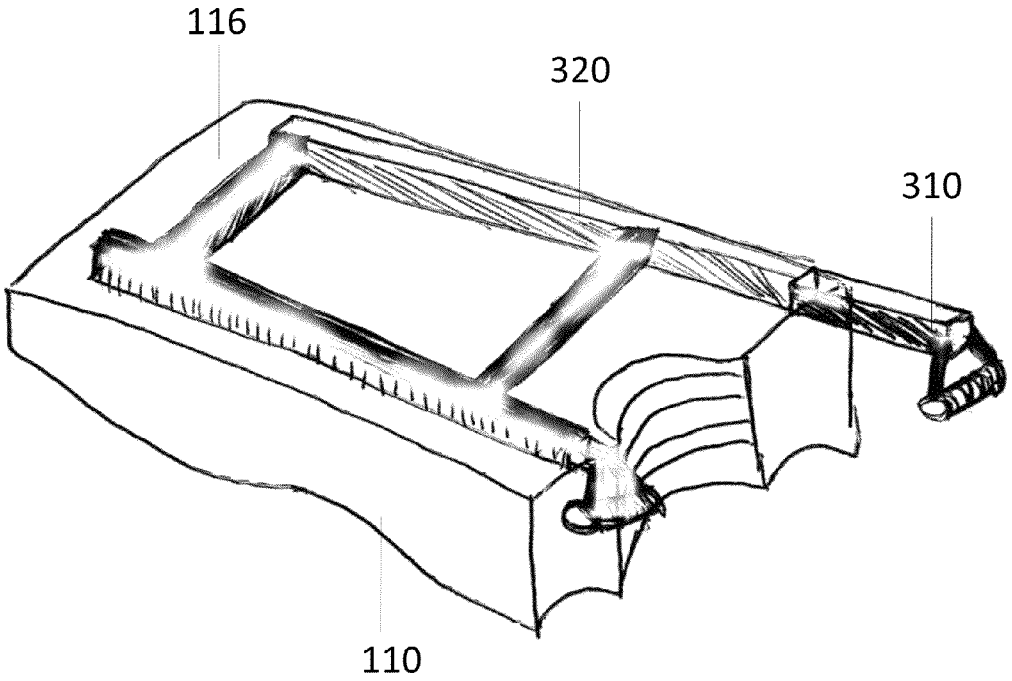
FIG. 15B shows a bottom view of the embodiment of FIG. 15A wherein the telescopic stirrups are housed in the base.

In some embodiments, the stirrups (310) may extend outwardly from or retract inwardly into the base (110), e.g., in a collapsible manner, a telescopic manner (e.g., see FIG. 15), or any other appropriate manner. The stirrups (310) may be temporarily housed in stirrup cavities (320) disposed inside the base (110) and accessible via stirrup openings (318) disposed in the front end (113) of the base (110). In some embodiments, the stirrups (310) can be pulled out of the stirrup cavities (320) and used during the procedure. In some embodiments, the stirrups (310) can be pulled out of the stirrup cavities (320) as desired and returned to the stirrup cavities (320) when a procedure is complete. In addition, in some embodiments, the stirrups (310) may have the ability to be adjusted laterally, thereby adjusting for patients of different sizes. An example of telescopic stirrups is shown in FIG. 15. Telescopic mechanisms are well known to one of ordinary skill in the art. The stirrups (310) slide in and out of a stirrup cavity (320). The stirrup cavity (320) may be located at or near the bottom surface (116) of the base (110), however the position if the stirrup cavity (320) is not limited to the configurations shown and described herein.

In some embodiments, the stirrups (310) are removably attachable to the base (110), e.g., the stirrups (310) can attach to the base (110) via an attachment means, e.g., a clip mechanism (optionally disposed on the front end (113) of the base (110)). As shown in FIG. 14C, a clip (334) may be disposed on the stirrup (310), e.g., the inside surface of the stirrup (310), wherein the clip (334) engages a clip connection (335) disposed on the base (110), e.g., the front surface (113) of the base (110).

Figure 13:
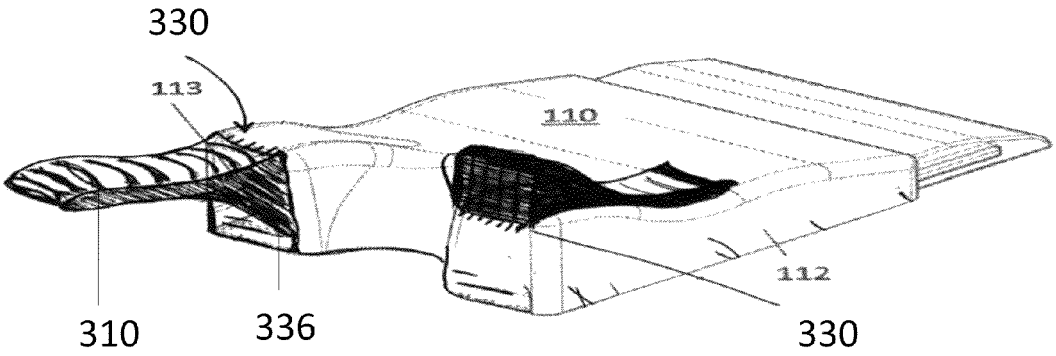
FIG. 13 shows a perspective view of an embodiment of the system of the present invention. The stirrups (or leg holders) are attached to the base via hinges.

As shown in FIG. 13 and FIG. 14, the stirrups (310) may be pivotally attached to the base (110), e.g., the front end (113) of the base (110), e.g., the top edge of the front end (113) of the base (110). The stirrups (310) may be attached via a hinge (330). The stirrups (310) may pivot between a storage position (shown on the right side in FIG. 13) wherein the stirrup (310) rests atop the base (110) and an extended position wherein the stirrup (310) pivots away from the base (110) and extends a distance from the base (110) (as shown on the left side in FIG. 13). The stirrups (310) may comprise stoppers (336) (e.g., flanges, stopper flanges) for limiting how far they can pivot (and so to properly position the stirrups (310)). Stopper flanges are shown in FIG. 13. In some embodiments, the hinge (330) functions to limit how far the stirrups (310) can pivot. In some embodiments, the stirrups (310) in the storage position nest with the peaks (150) of the base (110), e.g., in a stirrup cavity (e.g., an indentation within the top surface of the peaks (150)). In some embodiments, the stirrups (310) in the storage position are flush with the peaks (150) of the base (110).

Figure 14A:
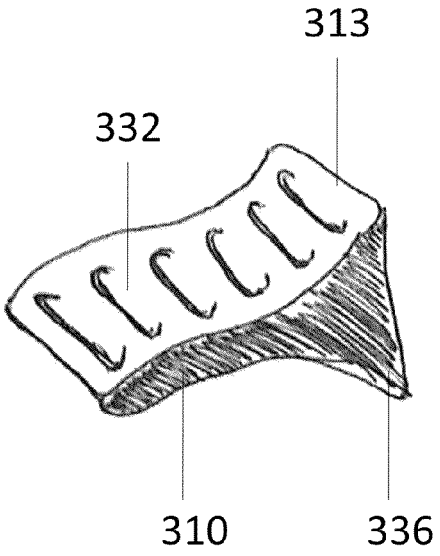
FIG. 14A is a detailed view of the stirrup of FIG. 13.

FIG. 14A shows a non-limiting example of a stirrup (310), e.g., a stirrup (310) for the embodiment in FIG. 13, in some embodiments, the stirrups (310) comprise stirrup indentations (332) disposed in the top surface (313) of the stirrup (310), which may be used for heel placement. The stirrup indentations (332) may be aligned parallel to one another, however the placement of the stirrup indentations (332) is not limited to a parallel configuration.

Figure 14B:
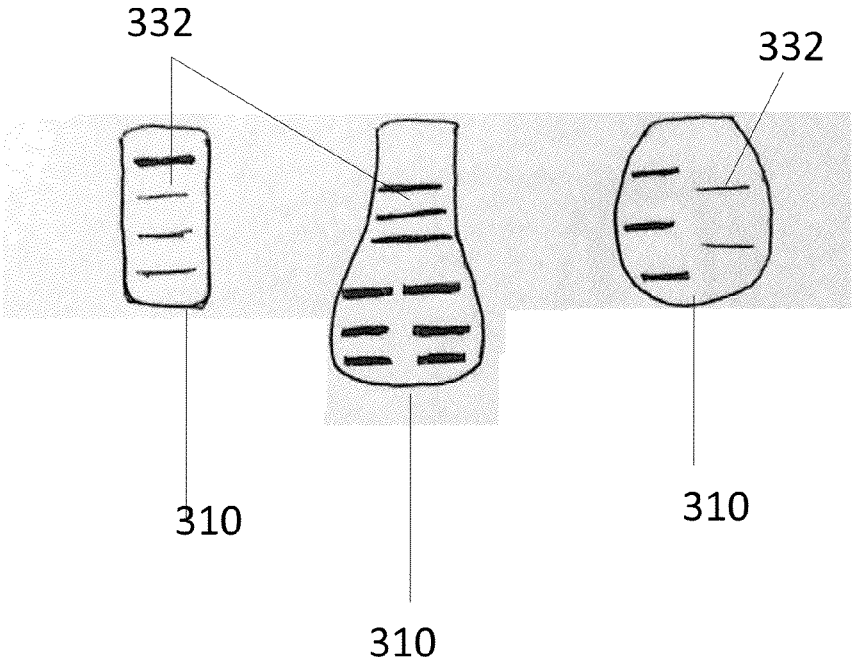
FIG. 14B is a top view of various configurations of stirrups.
Figure 14C:
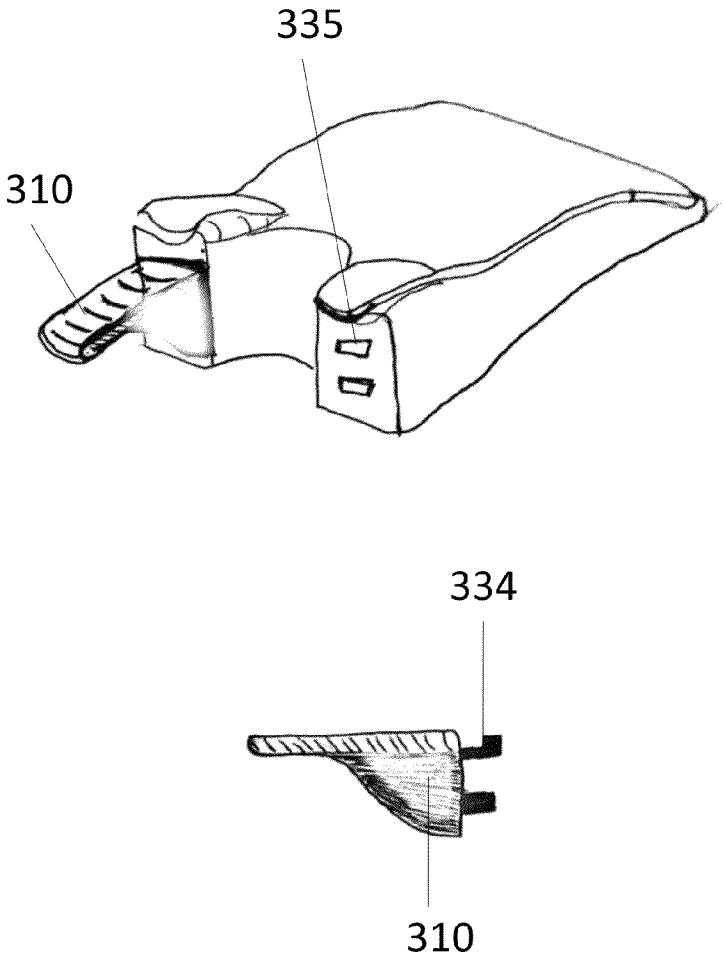
FIG. 14C shows en embodiment of the system of the present invention wherein the stirrups are attached to the base via an attachment means (e.g., the stirrups attach to the base via clips). Also shown is a side view of a stirrup that clips onto the base.
Figure 14D:
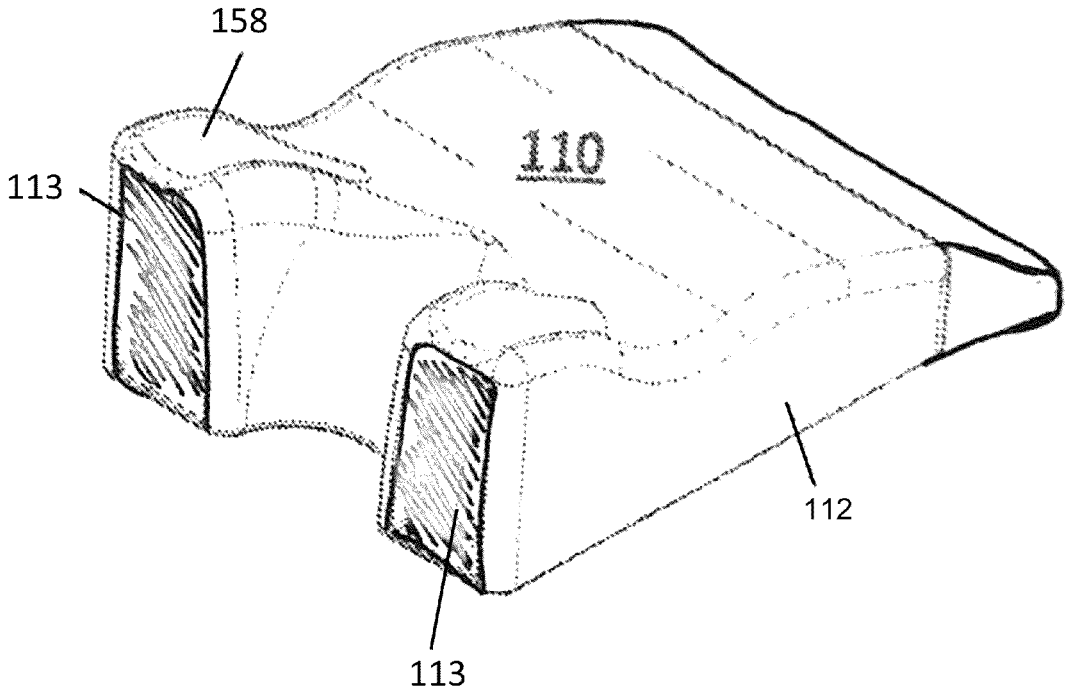
FIG. 14D shows a system of the present invention wherein no stirrups are attached to the front end of the base (in some embodiments, the system does not comprise stirrups).
Figure 14E:
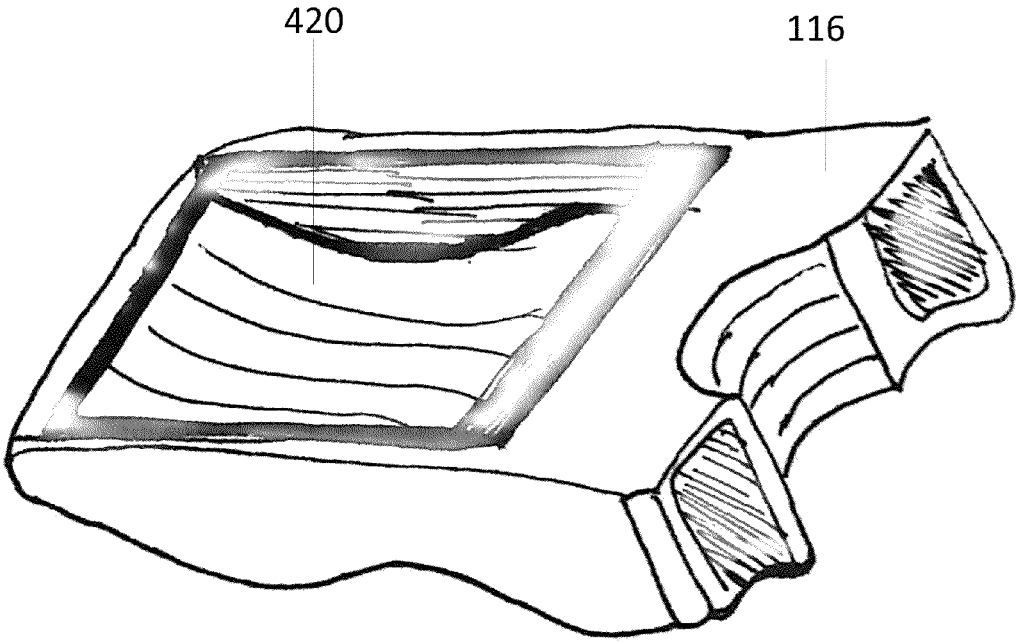
FIG. 14E shows a bottom perspective view of a system of the present invention wherein a bedpan is disposed in the bottom surface of the base.
Figure 14F:
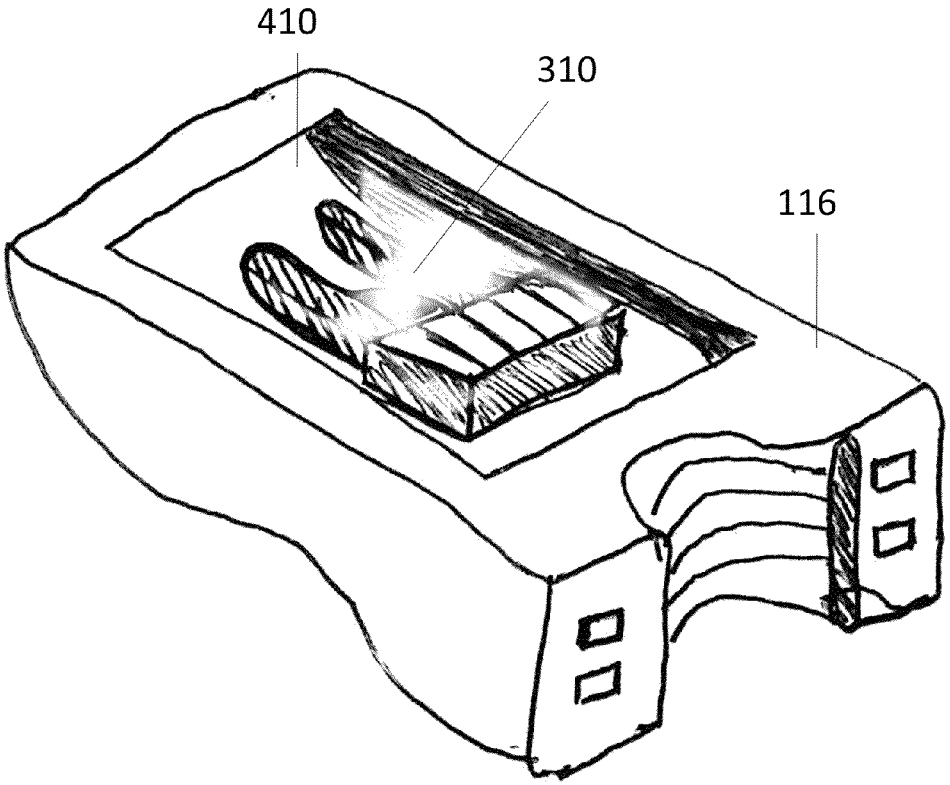
FIG. 14F shows a bottom perspective view of a system of the present invention wherein a storage compartment is disposed in the bottom surface of the base.

The stirrups (310) may be constructed in a variety of shapes and sizes. Examples of stirrup shapes are shown in FIG. 14B, which shows a rectangular shape, a rounded shape, and a combination rectangular-rounded shape. The shape of the stirrup is not limited to the examples shown herein.

The stirrups (310) may be positioned on opposite sides of the front end (113) of the base (110). For example, a first stirrup is positioned near the first side end (111) of the base (110), and a second stirrup is positioned near the second side end (112) of the base (110). The position of the stirrups may be any appropriate position on the front end (113) of the base (110). For example, the stirrups (310) may be positioned farther apart, closer to the bottom surface (116) of the base (110), closer to the top surface (115) of the base (110), etc., as compared to the configurations shown herein. In some embodiments, the stirrups (310) are attachable to the side ends of the base (110). In some embodiments, the stirrups (310) are stored or are accessible via the side ends of the base (110).

In some embodiments, the system (100) further comprises a backrest (350) attachable to or extendable outwardly from the back end (114) of the base (110). The backrest (350) may be used to aid in patient comfort and/or to help orient the patient and/or help provide balance. For example, the backrest may help stabilize the system (100) on the table so that the system (100) does not need to be attached (e.g., strapped) to the table. The backrest may help stabilize the system when an individual who is bottom-heavy is on the system (100), e.g., to prevent tipping. The backrest may help provide balance of the patient's weight when stirrups are used.

In some embodiments, the backrest (350) is removable from the base (110), e.g., the backrest (350) can attach to an attachment component disposed on the back end (114) of the base (110). In some embodiments, the backrest (350) may extend outwardly from or retract inwardly into the base (110). The backrest (350) may be housed in a backrest cavity (360) disposed inside the base (110) and accessible via an opening (362) disposed in the back end (114) of the base (110). The backrest (350) can be pulled out of the backrest cavity (360) as desired and returned to the backrest cavity (360) when a procedure is complete.

In some embodiments, the backrest (350) is attached to the base (110) via a hinge similarly to how the stirrups (310) are attached to the base (110) in FIG. 13. For example, the backrest (350) can fold or pivot away from the base (110) to an extended position and fold or pivot back to a position atop the base (110) to a storage position.

Figure 2:
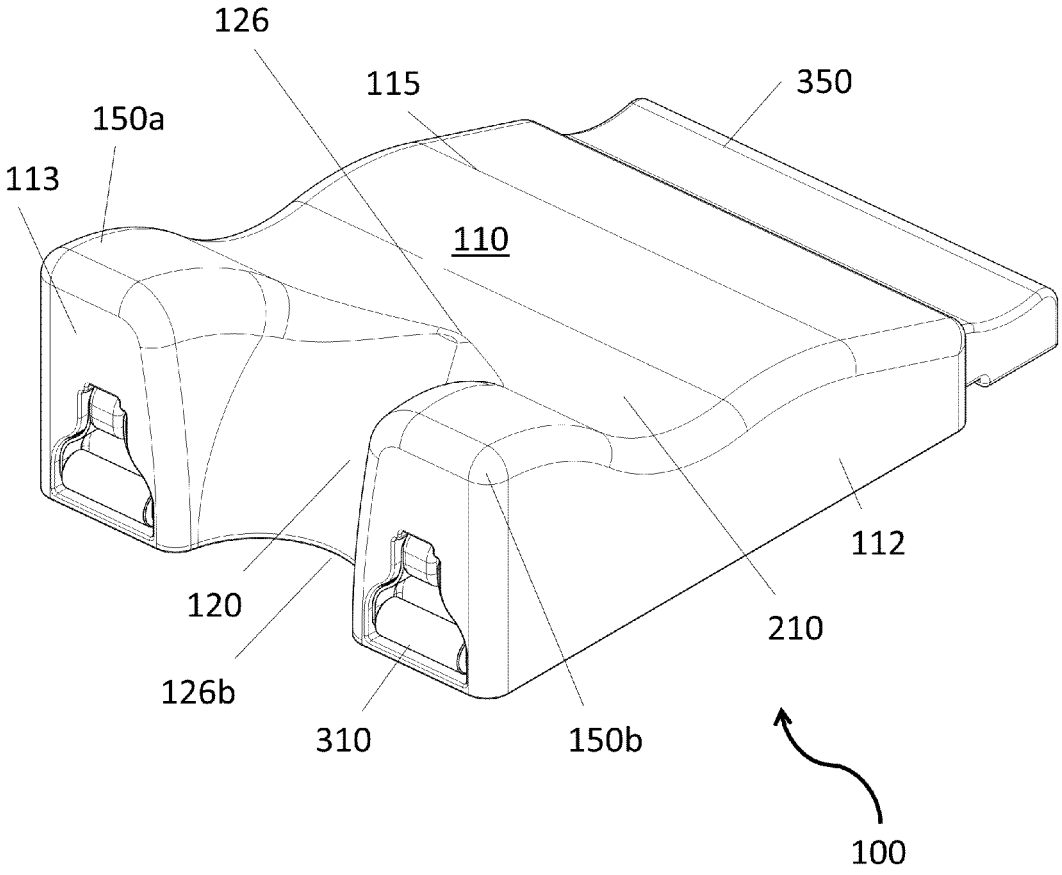
FIG. 2 is a perspective view of an embodiment of the system of the present invention.
Figure 3:
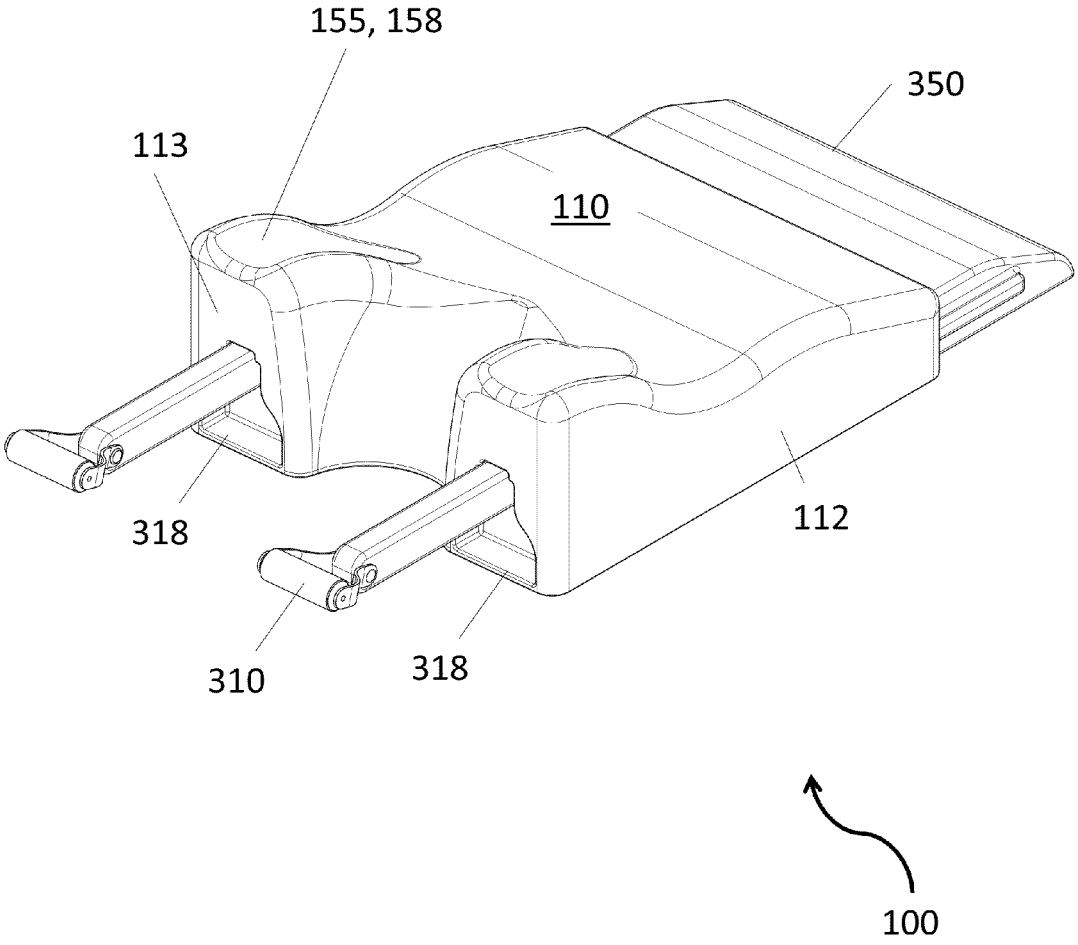
FIG. 3 is a perspective view of an embodiment of the system of the present invention.
Figure 4:
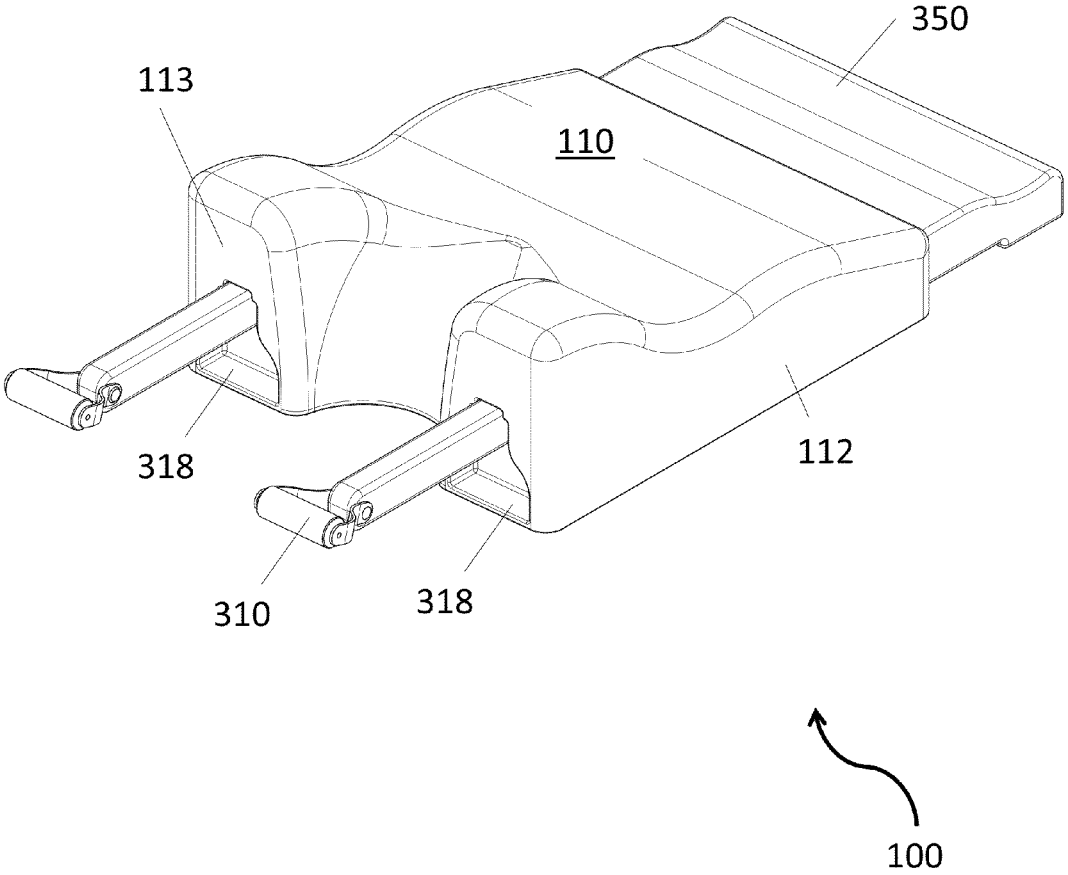
FIG. 4 is a perspective view of an embodiment of the system of the present invention.

The backrest (350) may be constructed in a variety of configurations. A first configuration is shown in FIG. 1 and FIG. 3. A second configuration is shown in FIG. 2 and FIG. 4. The first configuration has a tapered outer end, e.g., the outer end slopes toward the level of the bottom surface (116) of the base (110) (or the level of the table on which the system (100) is placed). The second configuration has a flat outer end, e.g., a generally rectangular cross section when viewed from the side. The present invention is not limited to the backrest (350) configurations described herein.

In some embodiments, the base (116) can be built in two pieces, for example a first half encompassing the first side (111) and a second half encompassing the second side (112). The two halves may expand and contract to lengthen or shorten the width of the base (110), the width being measured from the first side (111) to the second side (112) of the base (110). The expandability of the base (110) may be utilized to accommodate patients of different sizes (e.g., the width is lengthened to accommodate a larger patient). In some embodiments, the base (110) can expand to a desired width range of between about 15 to 25 inches. In some embodiments, the base (110) can expand to a desired width range of between about 15 to 30 inches. In some embodiments, the base (110) can expand to a desired width range of between about 15 to 40 inches.

The system (100) of the present invention may be constructed in a variety of sizes. For example, in some embodiments, the base (110) is between about 20 to 26 inches in width (see width 103*e* in FIG. 12) as measured from the first side (111) to the second side (112). In some embodiments, the base (110) is between about 15 to 30 inches in width (103*e*) as measured from the first side (111) to the second side (112). In some embodiments, the base (110) is more than about 30 inches in width (103*e*). In some embodiments, the base (110) is between about 20 to 26 inches in length (see length 103*f* in FIG. 12) as measured from the front end (113) to the back end (114). In some embodiments, the base (110) is between about 15 to 30 inches in length (103*f*) as measured from the front end (113) to the back end (114). In some embodiments, the base (110) is more than about 30 inches in length (103*f*). In some embodiments, the size, e.g., elevation, of the base (110) can be increased.

In some embodiments, the backrest (350) extends the length of the base (110), e.g., the length is measured from the outer end of the backrest (350) to the front end (113) of the base (110). In some embodiments, the base (110) is between about 20 to 40 inches in length when measured from the outer end of the backrest (350) to the front end (113) of the base (110).

In some embodiments, the height of the back end (114) of the base (110) is between about 2 to 4 inches (e.g., 2-3 inches) as measured from the intersection of the back end (114) of the base (110) and the bottom surface (116) of the base (110) and the back end (114) of the base (110) and the top surface (115) of the base (110).

In some embodiments, the depth (103*c*) of the indentation (120) (depth 103*c* shown in FIG. 12) is between about 3 to 6 inches as measured from the front end (113) of the base (110) to the innermost point of the indentation (120). In some embodiments, the depth of the indentation (120) is between about 4 to 6 inches as measured from the front end (113) of the base (110) to the innermost point of the indentation (120). In some embodiments, the depth of the indentation (120) is more than about 6 inches as measured from the front end (113) of the base (110) to the innermost point of the indentation (120).

Figure 12:
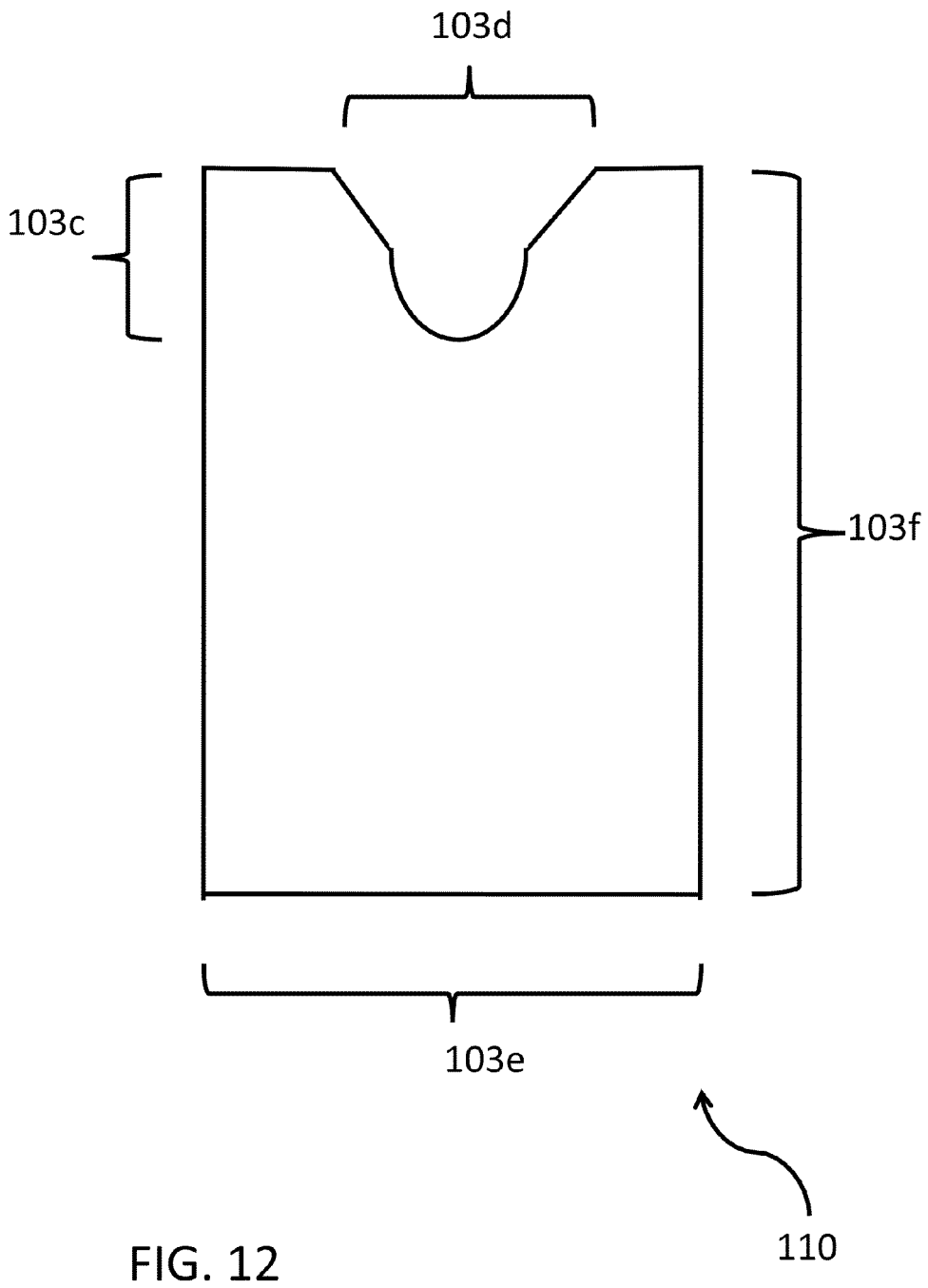
FIG. 12 shows a top cross sectional view of an embodiment of the system of the present invention.

In some embodiments, the width (103*d*) of the indentation (120) (width 103*d* shown in FIG. 12 referring to the width of the indentation (120) at the front end (113) of the base (110) is between about 8 to 15 inches (e.g., 10-13 inches). The width of the indentation (120) may narrow toward the innermost point of the indentation (120) (as shown in FIG. 12).

The present invention is not limited to the dimensions described herein.

Without wishing to limit the present invention to any theory or mechanism, it is believed that the system (100) of the present invention is advantageous because it is portable (e.g., can be moved from one surface to another and not limited to the end of a table), adjustable (e.g., can be adjusted to accommodate a patient's size and shape, e.g., the system may be configured to widen to accommodate a patient's pelvic width), intuitive (e.g., can provide cues to patients via indentations to properly position the patient) and comfortable for the patient (e.g., the contours and features of the system can provide a comfortable position for the patient). The system (100) is not limited to being used on a table. The system (100) may be used on any appropriate surface as desired. For example, in some embodiments, the system (100) is used on top of a bed or cart.

The system (100) may be constructed in a variety of materials, for example from materials appropriate for medical equipment and devices, e.g., materials that are easy to sterilize or clean in between use, padded materials for providing comfort, etc. Such materials are well known to one of ordinary skill in the art.

The system (100) of the present invention may be a solid piece, or the system (100) may be hollow, or a portion of the system (100) may be hollow.

In some embodiments, the system (100) is designed to be stackable, e.g., multiple systems may be stacked atop one another.

In some embodiments, a bedpan (420) is disposed in the bottom surface (116) of the base (110). In some embodiments, the bottom surface (116) of the base (110) or a portion thereof is designed in the configuration of a bedpan. Bedpans are well known to one of ordinary skill in the art.

In some embodiments, a storage cavity (410) is disposed in the bottom surface (116) of the base (110). The storage cavity (410) may be used to house the stirrups (310), e.g., if the stirrups (310) are attachable to the front surface (113) of the base (110). The storage cavity (410) is not limited to storage for the stirrups (310). For example, in some embodiments, the storage cavity (410) is used for storing a removable bedpan or other item.

In some embodiments, a gripping component (e.g., suction cups or the like) is disposed on the bottom surface (116) of the base (110). The gripping component may help secure the base (110) on top of the surface on which it is used.

In some embodiments, the system (100) of the present invention is manufactured as a one-time-use system, e.g., the system is disposable after one use. In some embodiments, the system (100) of the present invention is manufactured as a reusable product.

As used herein, the term "about" refers to plus or minus 10% of the referenced number.

The disclosures of the following U.S. Patents are incorporated in their entirety by reference herein: U.S. Pat. No. 6,256,817; U.S. Pat. Application No. 2011/0306901.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A pelvic positioning system (100) for positioning a patient's pelvic area for a pelvic or rectal exam, said system (100) comprising:

(a) a base (110) having a top surface (115), a bottom surface (116), a first side end (111) and a second side end (112) opposite the first side end (111), a front end (113), and a back end (114) opposite the front end (113);

(b) an indentation (120) disposed in the front end (113) of the base (110), the indentation (120) extends inwardly in the direction of the back end (114) of the base (110), the indentation (120) extends from a top inner edge (126) at the top surface (115) of the base (110) to a bottom inner edge (**126*b*) at the bottom surface (116) of the base (110), both the top inner edge (126) and the bottom inner edge (126*b*) are extended inwardly a distance from the front end (113) of the base (110**) to create a space for a physician to perform a pelvic exam;

(c) a first peak (**150*a*) extending upwardly from the top surface (115) of the base (110) at an intersection of the first side (111) of the base (110) and the front end (113) of the base (110), and a second peak (150*b*) extending upwardly from the top surface (115) of the base (110) at an intersection of the second side (112) of the base (110) and the front end (113) of the base (110), the peaks (150) are separated by the indentation (120); and (d) an inward curvature (210) disposed in the top surface (115) of the base (110) between a midsection (119) of the base (110) and the front end (113) of the base (110) extending from at or near the first side end (111) to at or near the second side end (112), the inward curvature 210 curves inwardly toward the bottom surface (116) of the base (110), the inward curvature (210) creates a midsection peak (220) in the top surface (115) of the base (110) behind the inward curvature (210), wherein a height of the top surface (115) of the base (110) at the midsection peak (220) is higher than a height of the top surface (115) of the base (110) at the inward curvature (210**).

2. The system (100) of claim 1, wherein the indentation (120) is U-shaped as viewed from the top surface (115).

3. The system (100) of claim 1, wherein the indentation (120) is rectangular as viewed from the top surface (115).

4. The system (100) of claim 1, wherein a peak indentation (158) is disposed in a top surface (155) of each peak (150).

5. The system (100) of claim 1, wherein inner side surfaces (152) of the peaks (150) slope downwardly toward the indentation (120).

6. The system (100) of claim 1, wherein inner side surfaces (152) of the peaks (150) form a concave peak curve (153) in combination with a top inner edge (126) of the indentation (120).

7. The system (100) of claim 1, wherein the top surface (115) of the base (110) slopes downwardly from the midsection peak (220) to the back end (114) of the base (110).

8. The system (100) of claim 1 further comprising a pair of stirrups (310).

9. The system (100) of claim 8, wherein the stirrups (310) are retractable and are housed in stirrup cavities (320) disposed inside the base (110) and accessible via openings (318) in the front end (113) of the base (110).

10. The system (100) of claim 8, wherein the stirrups (310) are removably attachable to the base (110) via an attachment means.

11. The system (100) of claim 10, wherein a clip (334) is disposed on an inside surface of the stirrup (310), the clip (334) engages a clip connection (335) disposed on the front surface (113) of the base (110).

12. The system (100) of claim 8, wherein the stirrups (310) are pivotally attached to the front end (113) of the base (110) at a top edge of the front end (113) of the base (110), the stirrups (310) are attached via hinges (330), wherein the stirrups (310) can pivot between a storage position wherein the stirrup (310) rests atop the base (110) and an extended position wherein the stirrup (310) pivots away from the base (110) and extends a distance from the base (110).

13. The system (100) of claim 1 further comprising a bedpan (420) disposed in the bottom surface (116) of the base (110).

14. The system (100) of claim 1 further comprising a storage cavity (410) disposed in the bottom surface (116) of the base (110).

15. The system (100) of claim 1 further comprising a backrest (350).

16. The system (100) of claim 15, wherein the backrest (350) is attachable to the back end (114) of the base (110).

17. The system (100) of claim 15, wherein the backrest (350) is extendable outwardly from the back end (114) of the base (110).

18. The system (100) of claim 15, wherein the backrest (350) is housed in a backrest cavity (360) disposed inside the base (110) and accessible via an opening (362) disposed in the back end (114) of the base (110).

* * * * *